US008869983B2

(12) United States Patent
Bruegmann

(10) Patent No.: US 8,869,983 B2
(45) Date of Patent: Oct. 28, 2014

(54) THEFT DETERRENT DEVICE FOR USE WITH PEG HOOK DISPLAYED PRODUCT CONTAINERS

(71) Applicant: Bruegmann USA, Inc., Houston, TX (US)

(72) Inventor: Malte Bruegmann, Houston, TX (US)

(73) Assignee: Bruegmann USA, Inc., Houston, TX (US)

( * ) Notice: Subject to any disclaimer, the term of this patent is extended or adjusted under 35 U.S.C. 154(b) by 10 days.

(21) Appl. No.: 13/855,847

(22) Filed: Apr. 3, 2013

(65) Prior Publication Data

US 2013/0256158 A1 Oct. 3, 2013

Related U.S. Application Data

(60) Provisional application No. 61/619,762, filed on Apr. 3, 2012.

(51) Int. Cl.

| | |
|---|---|
| ***B65D 73/00*** | (2006.01) |
| ***B65D 85/00*** | (2006.01) |
| ***E05B 73/00*** | (2006.01) |
| ***A47F 5/08*** | (2006.01) |
| ***B65D 5/42*** | (2006.01) |

(52) U.S. Cl.

CPC ..... *E05B 73/00* (2013.01); *B65D 5/4208* (2013.01); *A47F 5/0861* (2013.01); *A47F 5/0869* (2013.01); *Y10S 206/806* (2013.01)

USPC ..... 206/461; 206/1.5; 206/526; 206/806; 211/7; 211/59.1

(58) Field of Classification Search

USPC ..... 206/1.5, 461–471, 526, 806, 807; 211/4, 7, 57.1, 59.1, 59.2

See application file for complete search history.

(56) References Cited

U.S. PATENT DOCUMENTS

| | | | | |
|---|---|---|---|---|
| 3,080,963 | A * | 3/1963 | Rothgart | 206/0.84 |
| 4,896,770 | A * | 1/1990 | Calcerano et al. | 206/806 |
| 5,423,436 | A * | 6/1995 | Morrow | 211/59.1 |
| 5,957,422 | A | 9/1999 | Shea | |
| 6,070,747 | A | 6/2000 | Shea | |
| D435,435 | S | 12/2000 | Shea | |
| 6,202,866 | B1 | 3/2001 | Shea | |
| D464,837 | S | 10/2002 | Shea | |
| 7,118,000 | B2 | 10/2006 | Shea | |
| 7,350,645 | B1 * | 4/2008 | Sills | 206/461 |
| 7,624,871 | B2 * | 12/2009 | Sills | 206/461 |
| 7,712,616 | B2 | 5/2010 | Barkdoll | |
| 8,307,995 | B2 * | 11/2012 | Surma et al. | 211/7 |
| 8,376,150 | B2 * | 2/2013 | Surma et al. | 211/7 |
| 2011/0017627 | A1 * | 1/2011 | Wade et al. | 206/464 |

* cited by examiner

*Primary Examiner* — Bryon Gehman

(74) *Attorney, Agent, or Firm* — Richard A. Fagin

(57) ABSTRACT

A sweep theft resistant product container for a peg hook display includes a theft deterrent pad affixed to an upper portion of a product container. The product container has an opening for suspension of the product container from a peg hook display. The theft deterrent pad comprises an elastomer element having an opening therein for insertion of a peg hook of the peg hook display. The opening is configured to cause increase in friction sufficient to substantially prevent simultaneous removal of a plurality of product containers when the product containers are moved along the peg hook simultaneously.

7 Claims, 5 Drawing Sheets

THEFT DETERRENT DEVICE FOR USE WITH PEG HOOK DISPLAYED PRODUCT CONTAINERS

CROSS-REFERENCE TO RELATED APPLICATIONS

Priority is claimed from U.S. Provisional Application No. 61/619,762 filed on Apr. 3, 2012 and incorporated herein by reference in its entirety.

STATEMENT REGARDING FEDERALLY SPONSORED RESEARCH OR DEVELOPMENT

Not applicable.

BACKGROUND

This disclosure relates generally to the field of retail merchandise display devices and systems. More specifically, the disclosure relates to theft deterrent devices for use with product containers suspended from "peg hook" displays.

Peg hook product displays are well known in the art of retail merchandise display. Containers for peg hook displays typically have an opening formed through an upper part of the product container which enables the product to be suspended on a longitudinally extended hook. The hook may be mounted to a substantially vertical pegboard or similar structure having perforations or openings therein at selected spacings from each other that correspond to a mounting hook on a back side of the peg hook.

Theft of product from peg hook displays is a substantial problem for retailers. It is relatively easy for a thief to "sweep" a large number of product containers from a peg hook in a single motion, thus exposing the retailer to substantial theft loss in a short period of time.

Devices known in the art for theft deterrence include helically shaped peg-hooks that dispense product containers by rotating the peg hook. Other devices may include sensors to detect movement of individual product containers so that the retailer may be notified if a large number of containers are moved along a peg hook within a certain time frame. Still other theft deterrent devices are known in the art. See, e.g., U.S. Pat. No. 5,711,432 issued to Stein et al., and U.S. Pat. No. 5,375,725 issued to Rosenthal et al.

There is a need for a simple, inexpensive theft deterrent for peg hook displayed merchandise that provides ease of restocking.

SUMMARY

A sweep theft resistant product container for a peg hook display according to one aspect of the disclosure includes a theft deterrent pad affixed to an upper portion of a product container. The product container has an opening for suspension of the product container from a peg hook display. The theft deterrent pad comprises an elastomer element having an opening therein for insertion of a peg hook of the peg hook display. The opening is configured to cause increase in friction sufficient to substantially prevent simultaneous removal of a plurality of product containers when the product containers are moved along the peg hook simultaneously.

Other aspects and advantages will be apparent from the description and claims which follow.

BRIEF DESCRIPTION OF THE DRAWINGS

FIGS. 1A and 1B through 4A and 4B show side and face views, respectively, of examples of a theft deterrent pad for peg hook displayed product.

DETAILED DESCRIPTION

Figure 1A:
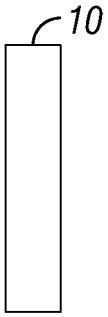
Figure 1B:
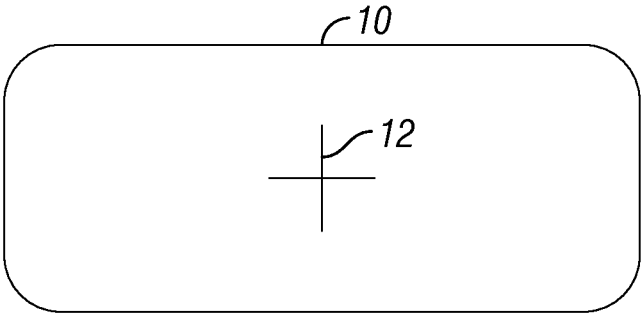
Figure 2A:
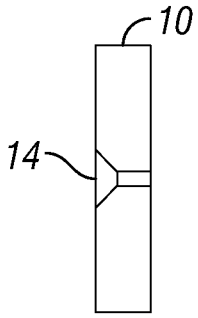
Figure 2B:
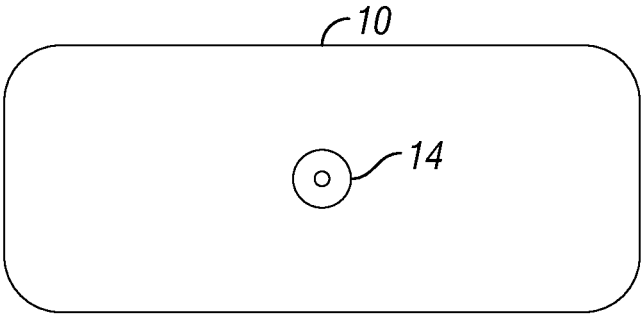

FIG. 1A shows a side view, and FIG. 1B shows a plan view of an example theft deterrent pad 10 usable with a peg hook displayed product container. The theft deterrent pad 10 may be made from elastomer, such as polyurethane, silicone rubber, flexible polyvinyl chloride or similar material. The thickness of the material from which the theft deterrent pad is made 10 may be selected to provide substantial resistance to motion along the peg hook without ripping or tearing in the event a thief tries to remove a substantial number or product containers (called "sweeping") from the peg hook simultaneously. A plan view of the theft deterrent pad 10 shown in FIG. 1B shows an example opening 12 in the pad 10 for insertion therethrough of the peg hook. The present example opening 12 may be in the form of two or more slits which may enable deflection of portions of the pad material adjacent to the slits to deflect under motion of the pad and affixed product container along the peg hook. The foregoing will be further explained with reference to FIGS. 6 and 7. FIGS. 2A and 2B, respectively show another example opening 14 in the theft deterrent pad 10. The example opening may include a semi-tapered hole 14 (FIG. 2A), in which the tapered portion (on the left hand side of the drawing in FIG. 2A) whose maximum internal diameter may be at least as large as an external diameter of the peg hook on which the product container is to be suspended. A cylindrical portion of the hole 14 may be a nominal fraction of the outside diameter of the peg hook. As configured, the hole 14 may enable relatively free movement of the theft deterrent pad 10 and associated product container in one direction to facilitate restocking the peg hook with product, yet provide more resistance to motion in the opposite direction to reduce the effectiveness of sweeping.

Figure 3A:
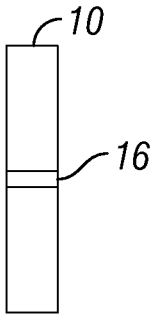
Figure 3B:
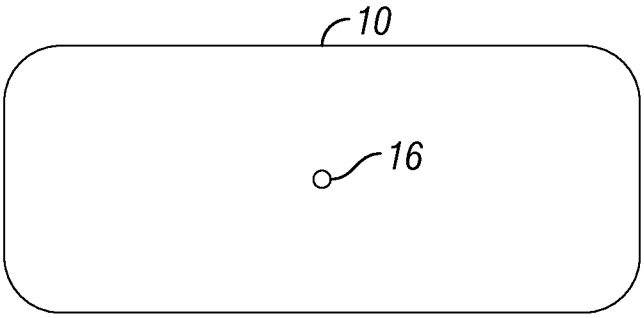
Figure 4A:
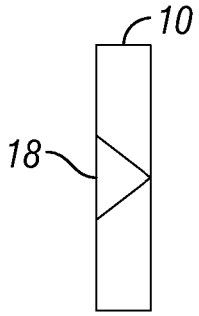
Figure 4B:
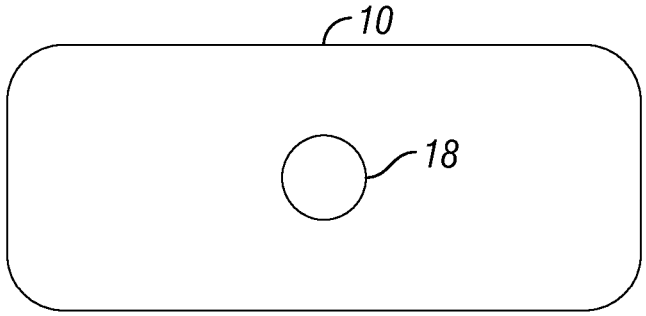

Another example opening shown in FIGS. 3A and 3B may be a substantially cylindrical hole 16 having a nominal inside diameter smaller than the outside diameter of the peg hook to provide substantial friction to motion of a plurality of product containers at one time. Another example opening is a fully tapered hole such as shown at 18 in FIGS. 4A and 4B. The example opening in FIGS. 4A and 4B may provide similar movement properties along the peg hook as the example opening shown in FIGS. 2A and 2B, with possibly less friction for movement onto the peg hook for restocking purposes.

Figure 5:
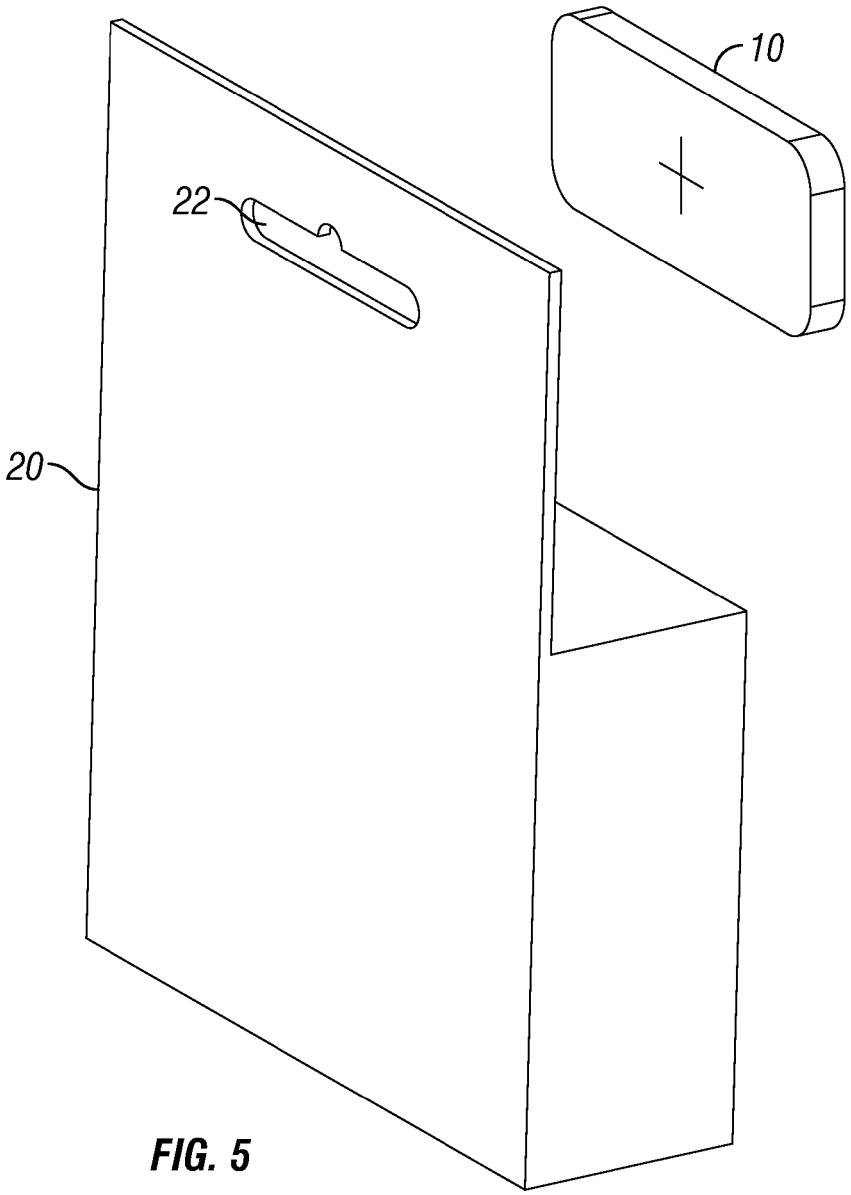
FIG. 5 shows affixing a theft deterrent pad to a product container.
Figure 6:
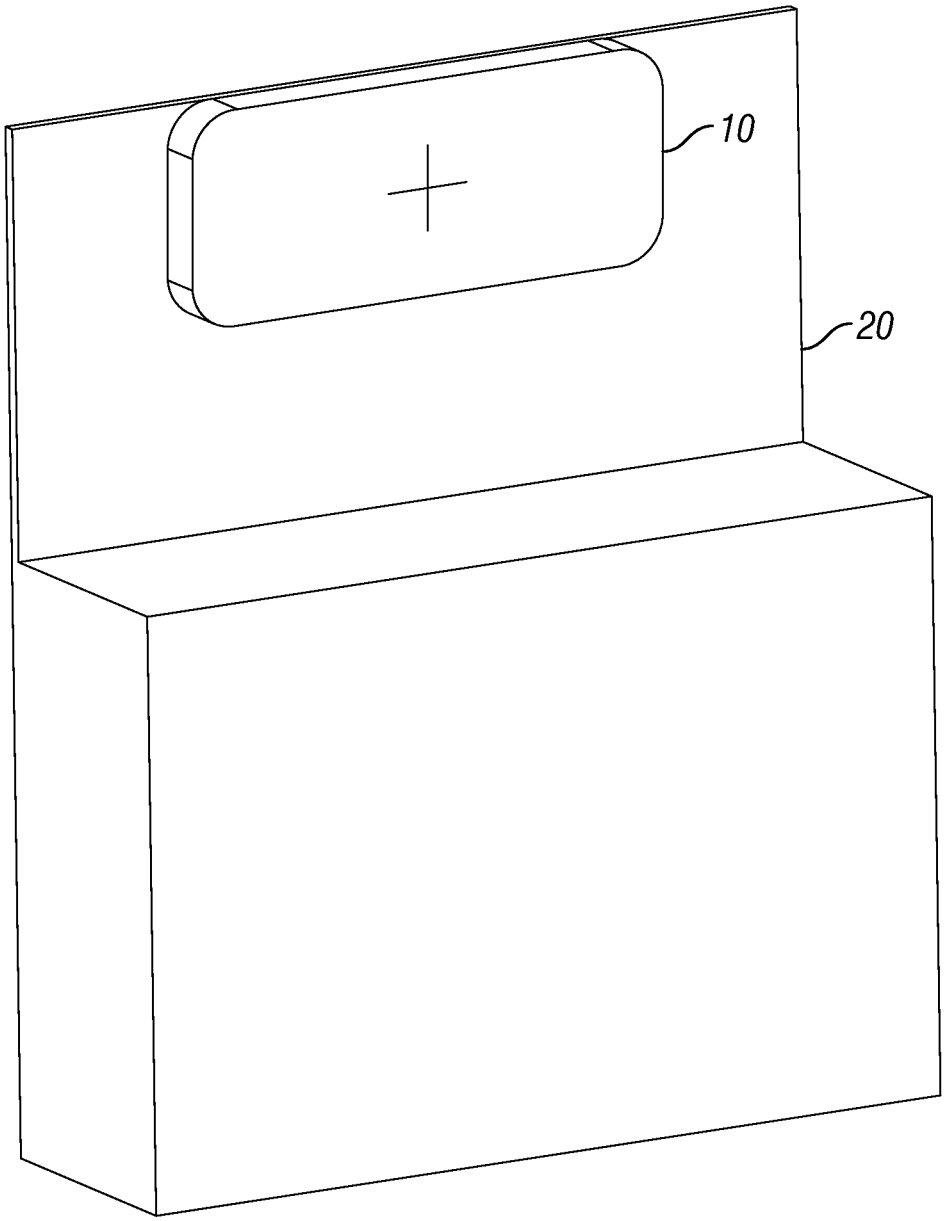
FIG. 6 shows the theft deterrent pad suspended on the product container of FIG. 5.

FIG. 5 shows an exploded view of a product container 20 having a typically shaped peg hook opening 22 and an example of the theft deterrent pad. An assembled view of the product container 20 and example theft deterrent pad 10 is shown in FIG. 6. The theft deterrent pad 10 may be affixed to the product container by any convenient method, including, without limitation, double sided adhesive tape, hot glue, wire staples, or curing adhesive.

Figure 7:
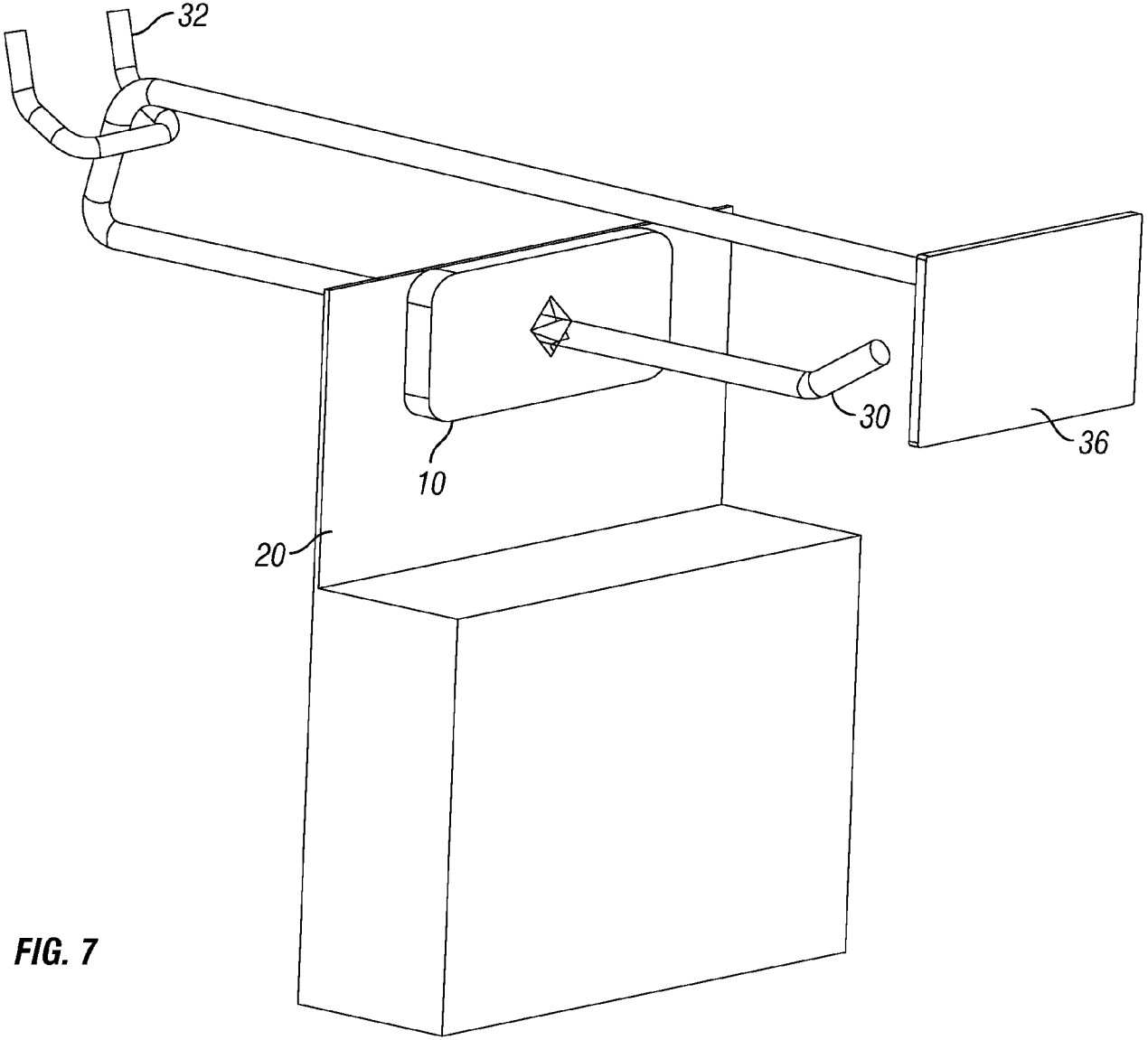
FIG. 7 shows a product container as in FIG. 6 suspended from a peg hook.

FIG. 7 shows the product container 20 having an example of the above described theft deterrent pad 10 affixed thereto suspended on a peg hook 30 as it would be used in a retail product display. The peg hook 30 may include an upper rod supporting a product description tag (or display) holder 36. The peg hook 30 may include pegboard engagement hooks 32 of conventional design. As will be appreciated by those skilled in the art, in some examples a U shaped portion of the peg hook 30 that connects the peg hook rod to the display holder rod 36 may be separately affixed to the peg board (not shown) to prevent removal of the entire peg hook in a single operation by a thief.

Figure 8:
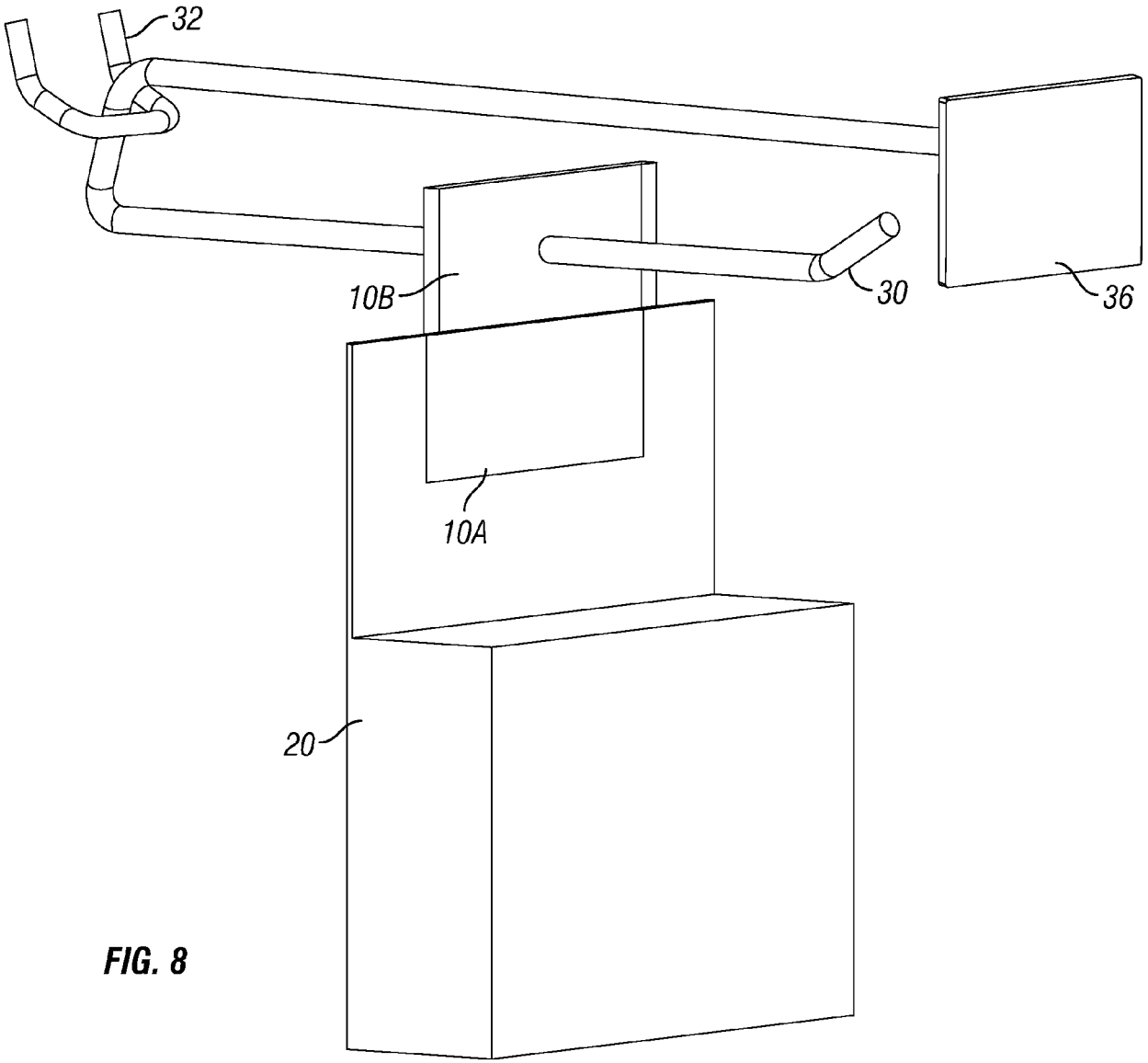
FIG. 8 shows another example container and theft deterrent pad suspended from a peg hook.

FIG. 8 shows the product container 20 having another example of the above described theft deterrent pad affixed thereto, wherein the theft deterrent pad may comprise an elastomer portion 10B and a rigid portion 10A suspended on a peg hook 30 as it would be used in a retail product display.

Testing of several example of a theft deterrent pad as explained above on peg hook suspended product containers has shown that attempted simultaneous removal of more than one product container results increasing the friction to a point where removal of a plurality of such product containers is inhibited or prevented.

A theft deterrent pad for peg hook suspended product containers according to the foregoing description may provide a relatively inexpensive, easy to use device for reducing the possibility of sweeping theft, thus reducing theft loss exposure to the retailer.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A sweep theft resistant product container for a peg hook display, comprising:

a theft deterrent pad affixed to an upper portion of a product container, the product container having an opening for suspension of the product container from a peg hook display; and wherein the theft deterrent pad comprises an elastomer element having an opening therein for insertion of a peg hook of the peg hook display, the opening configured to be in substantially continuous frictional contact with the peg hook and to increase friction between the peg hook and the theft deterrent pad to substantially prevent simultaneous removal of a plurality of product containers each having a respective theft deterrent pad when the plurality of product containers are moved along the peg hook simultaneously.

2. The product container of claim 1 wherein the elastomer element comprises at least one of silicone, flexible polyvinyl chloride and polyurethane.

3. The product container of claim 1 wherein the opening in the theft deterrent pad is configured to have reduced resistance to motion along the peg hook resulting from friction between the peg hook and the theft deterrent pad in one direction as compared to resistance to motion in the other direction.

4. The product container of claim 3 wherein the opening in the theft deterrent pad comprises a semi-tapered hole having a tapered portion and a cylindrical portion, a maximum internal diameter of the tapered portion being at least as large as an external diameter of the peg hook, the cylindrical portion having an internal diameter being a nominal fraction of the external diameter of the peg hook.

5. The product container of claim 1 wherein the opening in the theft deterrent pad comprises a plurality of slits in the theft deterrent pad.

6. The product container of claim 1 wherein the opening in the theft deterrent pad comprises a substantially cylindrical hole having a nominal inside diameter smaller than an outside diameter of the peg hook.

7. The product container of claim 1 wherein the opening in the theft deterrent pad comprises a tapered hole.

* * * * *